US007297092B1

(12) United States Patent
Gaynor

(10) Patent No.: US 7,297,092 B1
(45) Date of Patent: Nov. 20, 2007

(54) ATHLETE TRAINING DEVICE

(76) Inventor: Tyrone Gaynor, 549 Cary St. 2ed Floor, Orange, NJ (US) 07050

( * ) Notice: Subject to any disclaimer, the term of this patent is extended or adjusted under 35 U.S.C. 154(b) by 67 days.

(21) Appl. No.: 11/389,626

(22) Filed: Mar. 27, 2006

Related U.S. Application Data

(60) Provisional application No. 60/678,814, filed on May 9, 2005.

(51) Int. Cl.
*A63B 69/20* (2006.01)
*A63B 69/22* (2006.01)

(52) U.S. Cl. ..... 482/86; 482/90

(58) Field of Classification Search ..... 482/83–90; D21/787, 798; 273/440.1, 317.8, 108.3; 473/441, 422, 423; 40/607.01, 607.04
See application file for complete search history.

(56) References Cited

U.S. PATENT DOCUMENTS

| | | | | | |
|---|---|---|---|---|---|
| 825,860 | A * | 7/1906 | McKenzie | 482/90 |
| 2,435,864 | A * | 2/1948 | Adams | 482/90 |
| 2,696,383 | A * | 12/1954 | Noftsinger | 473/441 |
| 2,697,603 | A * | 12/1954 | Haines | 473/430 |
| 4,817,941 | A | 4/1989 | McCorry | |
| D334,784 | S | 4/1993 | DeZulueta | |
| 5,389,057 | A * | 2/1995 | Zagata, Jr. | 482/83 |
| D356,127 | S | 3/1995 | Mara | |
| 5,464,377 | A | 11/1995 | Beeman | |
| 5,472,186 | A * | 12/1995 | Paulsen | 473/429 |
| 5,624,358 | A | 4/1997 | Hestilow | |
| 5,722,920 | A | 3/1998 | Bauer | |
| 5,800,319 | A | 9/1998 | Chonte | |
| 5,899,835 | A * | 5/1999 | Puranda | 482/90 |
| 5,957,789 | A * | 9/1999 | Ainscough et al. | 473/423 |
| 6,398,697 | B1 | 6/2002 | Nichols, Jr. | |
| 6,685,146 | B1 * | 2/2004 | Sanchez, Jr. | 248/125.7 |
| 6,736,764 | B1 | 5/2004 | Kapustka | |
| 6,872,171 | B2 | 3/2005 | Haselrig | |
| 7,008,353 | B2 * | 3/2006 | Haeffer | 482/83 |
| 7,150,700 | B2 * | 12/2006 | MacKay et al. | 482/83 |
| 2002/0013198 | A1 | 1/2002 | Mackay | |
| 2005/0124469 | A1 | 6/2005 | Melvin | |
| 2007/0167297 | A1 * | 7/2007 | Stevenson | 482/83 |

* cited by examiner

*Primary Examiner*—Stephen R. Crow
*Assistant Examiner*—Allana Lewin

(57) ABSTRACT

A rotatable training device includes a base that has an aperture formed therein. An elongated support member has a bottom end nested within the aperture and extends vertically upward therefrom, and has a bore formed therein. A mobile rectilinear rod is telescopically seated within the bore and has a top end terminating above and to an exterior of the support member. The rod includes a spring-loaded stop member that is connected to a bottom end thereof. A circular dial is positioned about the rod top end. An arm is telescopically positioned about the rod and is rotatable along a 360 degrees arcuate path in clockwise and counter clockwise directions. The arm has a flange portion extending from the rod and situated beyond an outer base perimeter. Padded punching pillows are affixed to front and rear sides of the flange portion. Detachable protective covers are affixed to the punching pillows.

18 Claims, 6 Drawing Sheets

ATHLETE TRAINING DEVICE

CROSS REFERENCE TO RELATED APPLICATIONS

This application claims the benefit of U.S. Provisional Application No. 60/678,814, filed May 9, 2005.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Technical Field

This invention relates to training devices and, more particularly, to an athlete training device for improving athlete hand-eye coordination during exercise regimens.

2. Prior Art

Today there is a great emphasis on physical fitness. Popular with many people are boxing, kick boxing, karate and other martial arts which offer the practitioners both physical fitness and self-protection. Students of such self-defense arts often use pads that are struck with their hands and/or feet to improve hand-eye coordination and to improve their strength. These pads are usually held by the instructor or another student in the class.

There are a number of drawbacks to this practice of having a second party hold the strike bag for another person. First and foremost, there is a possibility that the person striking the bag may do so with such force that they actually injure the person holding the bag, or they can accidentally misjudge the location of the bag and strike the bag holder. Another disadvantage, especially when the instructor is holding the bag, is that it is hard for the instructor to evaluate the striker's performance and form from behind the strike bag.

Accordingly, a need remains for an athlete training device in order to overcome the above-noted shortcomings. The present invention satisfies such a need by providing a training device that is convenient and easy to use, is portable in design, is safe to use and is versatile in its uses. Such a device allows the user to enhance their hand-eye coordination, strike speed, reflex responses, and their punching or kicking power. This advantageously helps the person to build their self confidence in preparation for athletic competitions and/or self-defense situations. The athlete training device helps a trainee to increase their ability to deliver accurate punches to a desired strike zone, which can conserve a lot of their energy over extended periods of time. Such a training device is also portable, conveniently allowing same to be used for training and recreational activities at a variety of locations.

BRIEF SUMMARY OF THE INVENTION

In view of the foregoing background, it is therefore an object of the present invention to provide an athlete training device. These and other objects, features, and advantages of the invention are provided by a rotatable training device for improving athlete hand-eye coordination during exercise regimens.

The rotatable training device includes a stationary base member that has a central aperture formed therein and is positioned directly on a ground surface. An elongated and stationary support member has a bottom end directly nested within the aperture and extends vertically upward therefrom. Such a support member has an axial bore formed therein. The axial bore extends through an entire longitudinal length of the support member.

A mobile rectilinear rod has a fixed longitudinal length telescopically seated within the bore. Such a rod is centrally disposed above the base member and has a top end terminating at a location above and to an exterior of the support member. The rod includes a spring-loaded stop member that is directly connected to a bottom end thereof for effectively providing resilient support to the arm during exercise procedures.

A circular dial is removably and rotatably positioned about the top end of the rod. Such a circular dial is seated directly on a top surface of the support member. The dial may have a diameter smaller than a diameter of the support member such that the dial effectively remains supported at equilibrium and along a horizontal plane while the arm rotates thereon. Such a dial preferably remains stationary when the arm rotates about a fulcrum axis defined along the rod.

An arm is telescopically positioned directly about the rod in such a manner that the arm rests on the dial and remains spaced from the support member. Such an arm is selectively rotatable in clockwise and counter clockwise directions. The arm is rotatable along a 360 degree arcuate path. Such an arm has a flange portion radially extending from the rod and situated at a position beyond an outer perimeter of the base member such that the athlete can advantageously readily access the arm while remaining spaced from the base member. The flange portion of the arm preferably has an oval shape for effectively simulating a trainer hand during exercising procedures. Such an arm and the rod may be telescopically detachable from the support member so that the athlete can advantageously quickly disassemble the device.

The arm preferably includes a stabilizing portion and a vertical portion monolithically formed therewith. Such a vertical portion has a bore formed therein that is arranged in such a manner that the vertical portion is telescopically and rotatably seated about the rod. The stabilizing portion is oppositely positioned from the flange so that the arm is advantageously and effectively prohibited from undesirably disconnecting from the rod when an upward force is exerted onto the punching pillow.

A plurality of padded punching pillows are directly affixed to front and rear sides of the flange portion. A plurality of protective covers are directly affixed to the punching pillows respectively. Each of the protective covers is detachable from corresponding ones of the punching pillows.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
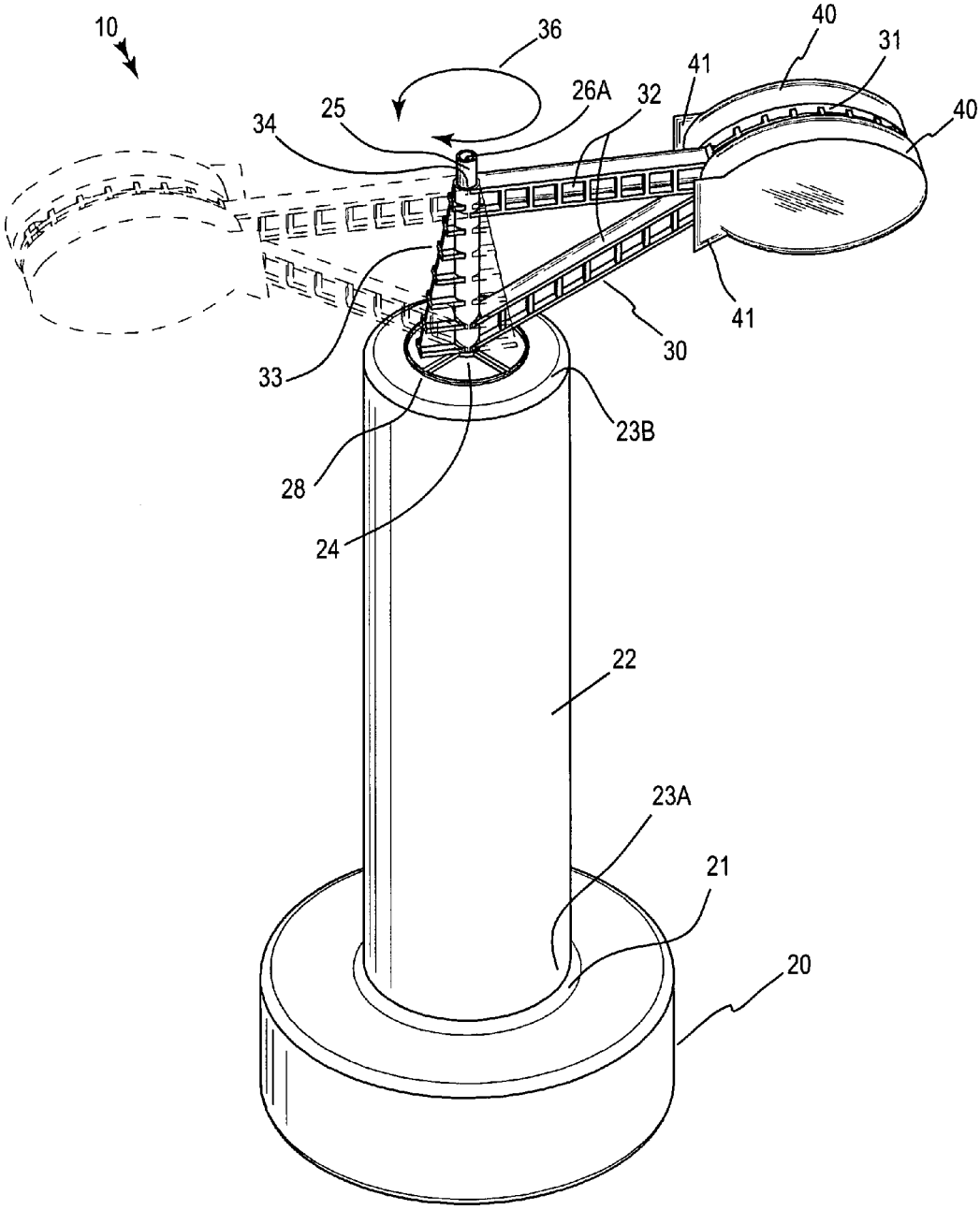
FIG. 1 is a perspective view showing a rotatable athlete training device, in accordance with the present invention.
Figure 2:
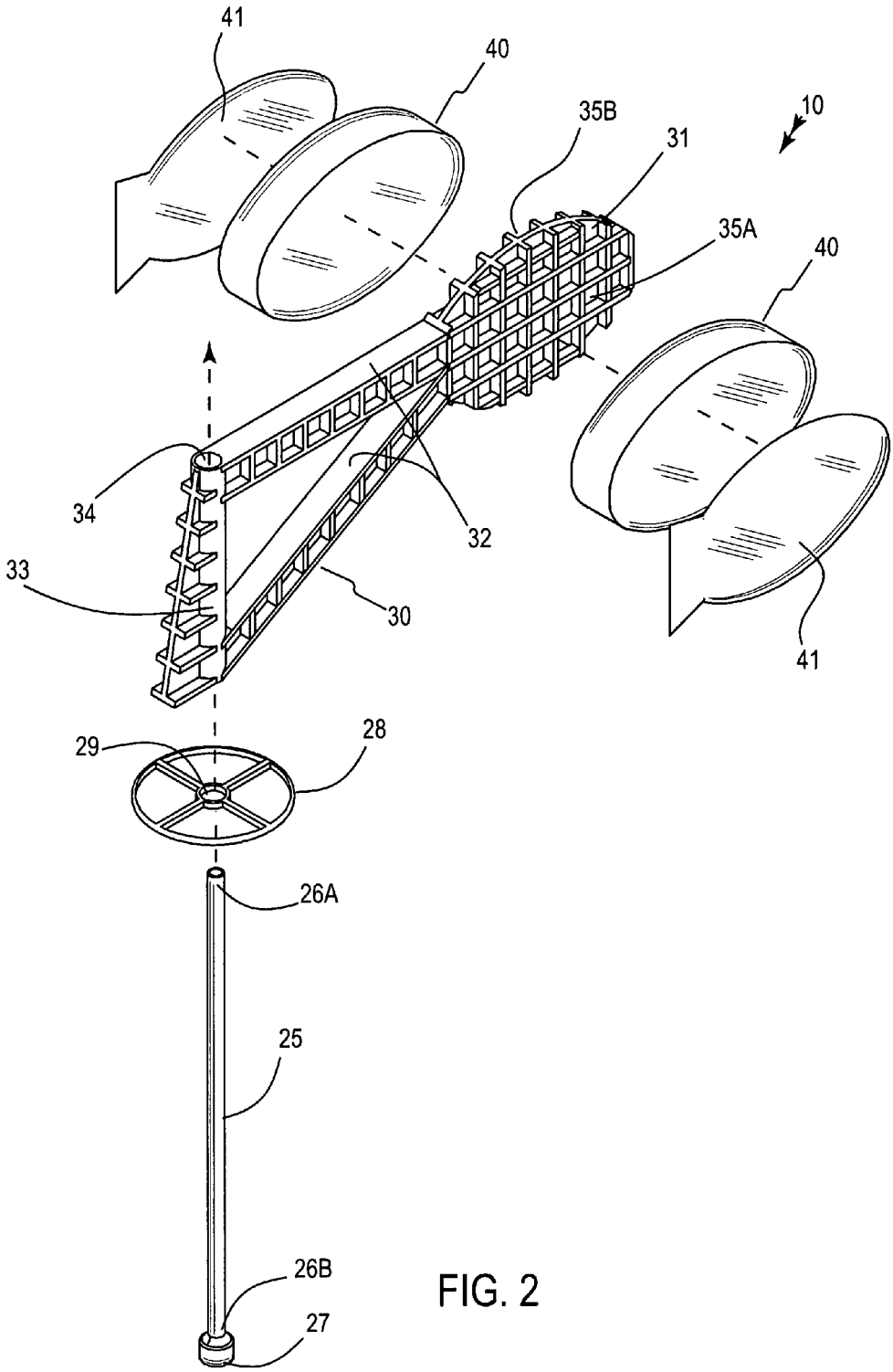
FIG. 2 is an exploded perspective view of the device shown in FIG. 1, showing the arm, the plurality of punching pillows, the plurality of protective covers, the rectilinear rod, and the circular dial.
Figure 3:
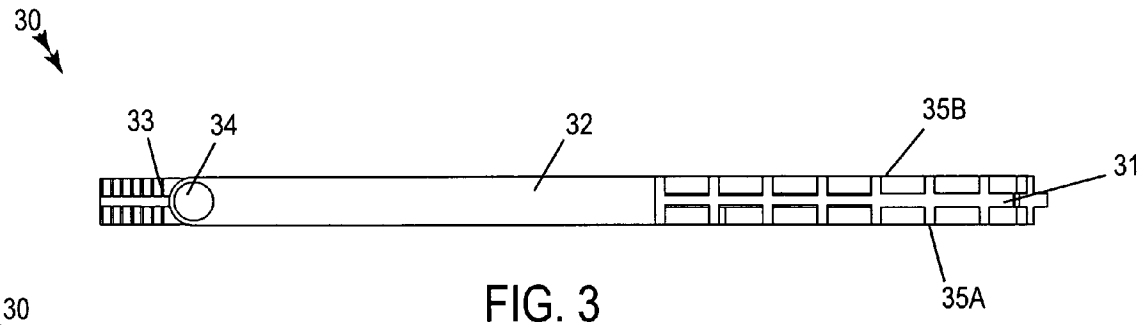
FIG. 3 is a top plan view of the arm shown in FIG. 2.
Figure 5:
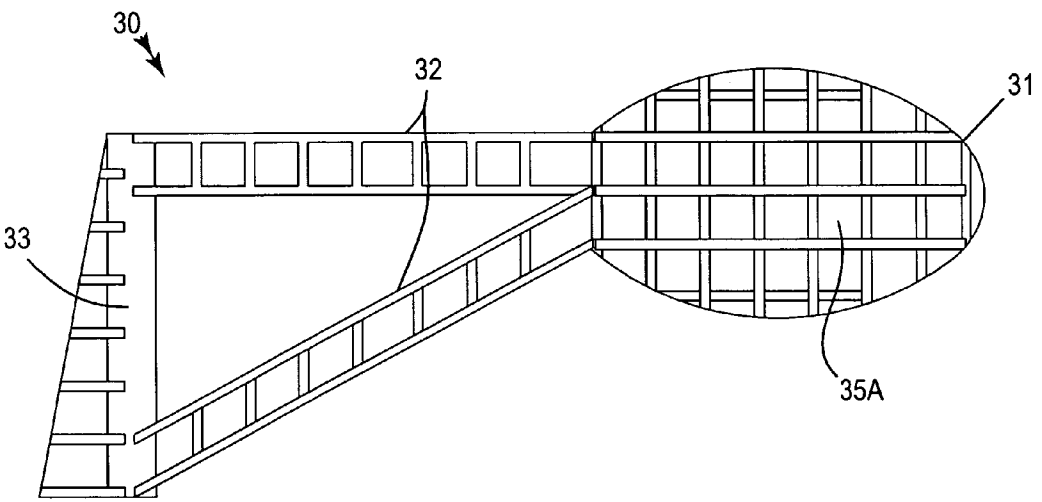
FIG. 5 is front-elevational view of the arm shown in FIG. 2.
Figure 4:
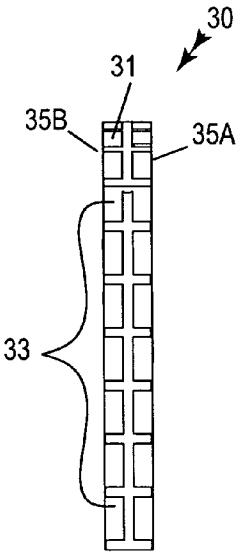
FIG. 4 is a side-elevational view of the arm shown in FIG. 2.
Figure 6:
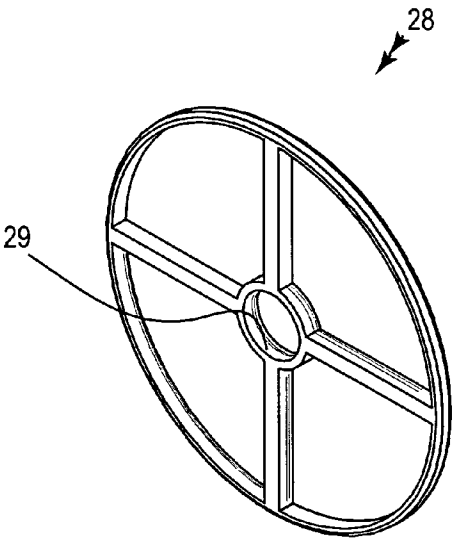
FIG. 6 is perspective view of the circular dial shown in FIG. 2.
Figure 7:
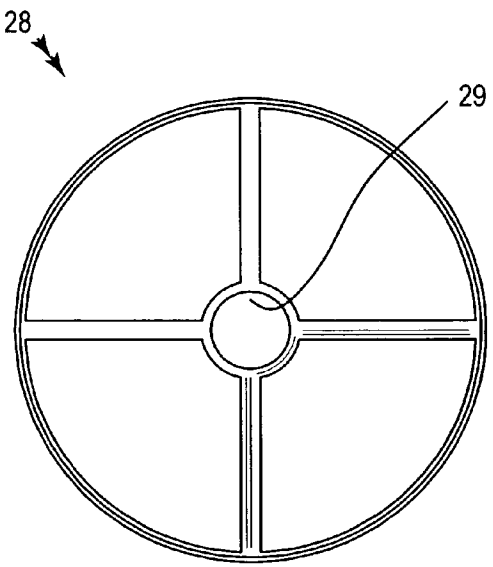
FIG. 7 is a front-elevational view of the circular dial shown in FIG. 6.
Figure 8:
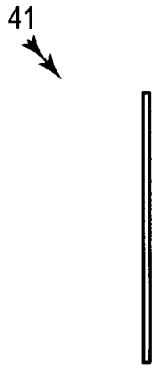
FIG. 8 is a side-elevational view of the protective cover shown in FIG. 2.
Figure 9:
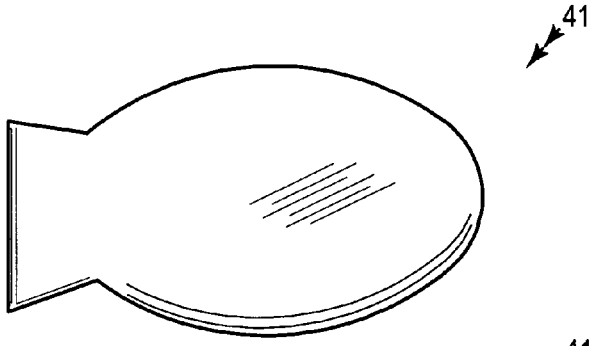
FIG. 9 is a front-elevational view of the protective cover shown in FIG. 2.
Figure 10:
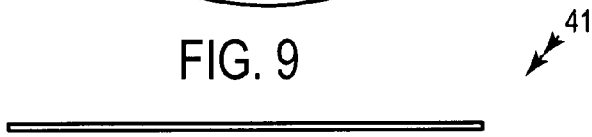
FIG. 10 is top plan view of the protective cover shown in FIG. 2.
Figure 11:
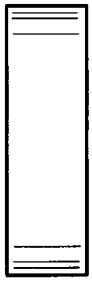
FIG. 11 is a side-elevational view of the padded punching pillow shown in FIG. 2.
Figure 12:
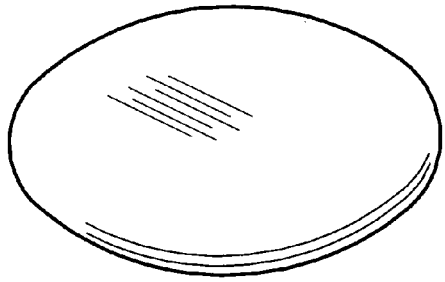
FIG. 12 is a front-elevational view of the padded punching pillow shown in FIG. 2.
Figure 13:
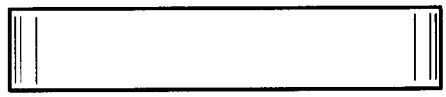
FIG. 13 is a top plan view of the padded punching pillow shown in FIG. 2.
Figure 14:
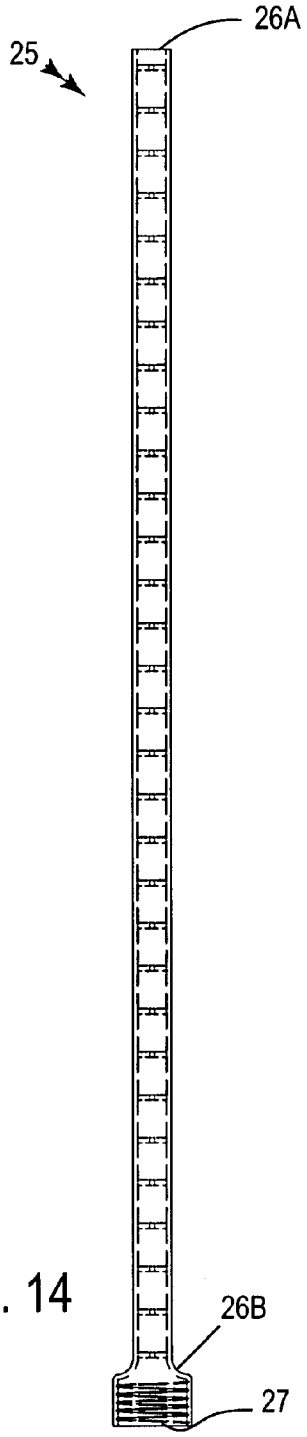
FIG. 14 is a side-elevational view of the rectilinear rod shown in FIG. 2.
Figure 15:
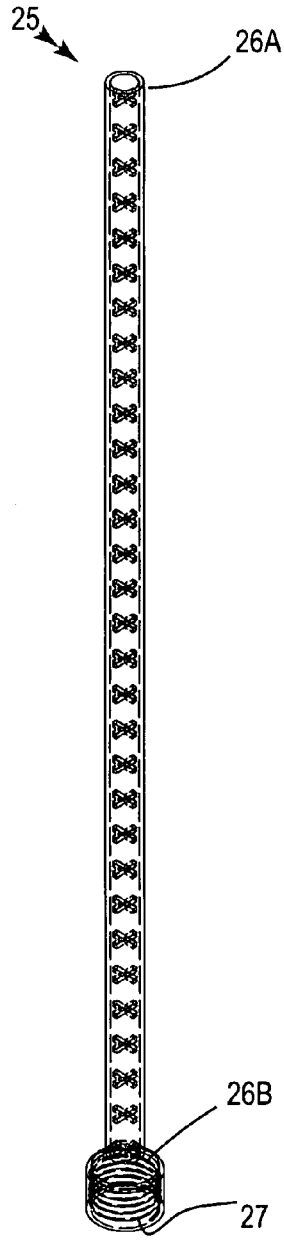
FIG. 15 is an enlarged perspective view of the rectilinear rod shown in FIG. 2.
Figure 16:
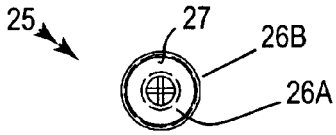
FIG. 16 is a top plan view of the rectilinear rod shown in FIG. 2.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-16 by the reference numeral 10 and is intended to provide a rotatable athlete training device. It should be understood that the device 10 may be used to train for many different types of sports and activities, and should not be limited in use to only training martial arts type sports.

Initially referring to FIG. 1, the device 10 includes a stationary base member 20 that has a central aperture 21 formed therein and is positioned directly on a ground surface. An elongated and stationary support member 22 has a bottom end 23A directly nested, without the use of intervening elements, within the aperture 21 and extends vertically upward therefrom. Such a support member 22 has an axial bore 24 formed therein. The axial bore 24 extends through an entire longitudinal length of the support member 22.

Referring to FIGS. 1, 2, 14, 15 and 16, a mobile rectilinear rod 25 has a fixed longitudinal length telescopically seated within the bore 24. Such a rod 25 is centrally disposed above the base member 20 and has a top end 26A terminating at a location above and to an exterior of the support member 22, as is best illustrated in FIG. 1. The rod 25 includes a spring-loaded stop member 27 that is directly connected, without the use of intervening elements, to a bottom end 26B thereof and is essential for effectively providing resilient support to the arm 30 (described herein below) during exercise procedures.

Referring to FIGS. 1, 2, 6 and 7, a circular dial 28 is removably and rotatably positioned about the top end 26A of the rod 25. Such a circular dial 28 is seated directly, without the use of intervening elements, on a top surface 23B of the support member 22. The dial 28 has a diameter smaller than a diameter of the support member 22, which is important such that the dial 28 effectively remains supported at equilibrium and along a horizontal plane while the arm 30 rotates thereon. Such a dial 28 remains stationary when the arm 30 rotates about a fulcrum axis defined along the rod 25. The dial 28 has a central aperture 29 that is important for allowing the rod 25 to pass therethrough.

Referring to FIGS. 1, 2, 3, 4 and 5, an arm 30 is telescopically positioned directly, without the use of intervening elements, about the rod 25 in such a manner that the arm 30 rests on the dial 28 and remains spaced from the support member 22. Such an arm 30 is selectively rotatable in clockwise and counter clockwise directions. The arm is rotatable along a 360 degree arcuate path, as is best indicated by the arrow 36 shown in FIG. 1. This is a crucial feature for allowing a user to conveniently strike the padded punching pillows 40 (described herein below) from either side thereof. Such an arm 30 has a flange portion 31 radially extending from the rod 25 and situated at a position beyond an outer perimeter of the base member 20, which is vital such that the athlete can advantageously readily access the arm 30 while remaining spaced from the base member 20.

The flange portion 31 of the arm 30 has an oval shape that is critical for effectively simulating a trainer hand during exercising procedures. Of course, the flange portion 31 may be produced in a variety of alternate shapes for simulating other strike zones, like a torso or head to name a few, as is obvious to a person of ordinary skill in the art. Such an arm 30 and the rod 25 are telescopically detachable from the support member 22, which is essential so that the athlete can advantageously quickly disassemble the device 10 for quick and easy storage or transport thereof.

Again referring to FIGS. 1 through 5, the arm 30 includes a stabilizing portion 32 and a vertical portion 33 monolithically formed therewith. Such a vertical portion 33 has a bore 34 formed therein that is arranged in such a manner that the vertical portion 34 is telescopically and rotatably seated about the rod 25, as is best illustrated in FIG. 1. The stabilizing portion 32 is oppositely positioned from the flange 31, which is crucial so that the arm 30 is advantageously and effectively prohibited from undesirably disconnecting from the rod 25 when an upward force is exerted onto the punching pillow 40.

Referring to FIGS. 1, 2, 8, 9, 10, 11, 12 and 13, a plurality of padded punching pillows 40 are directly affixed, without the use of intervening elements, to front 35A and rear 35B sides of the flange portion 31. A plurality of protective covers 41 are directly affixed, without the use of intervening elements, to the punching pillows 40 respectively. Each of the protective covers 41 is detachable from corresponding ones of the punching pillows 40. Of course, the punching pillows 40 and the protective covers 41 may be produced in a variety of alternate shapes and sizes for effectively accommodating any alternately shaped flange members 31, as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A rotatable training device for improving athlete hand-eye coordination during exercise regimens, said rotatable training device comprising:

a stationary base member having a central aperture formed therein and positioned directly on a ground surface;

an elongated and stationary support member having a bottom end directly nested within said aperture and extending vertically upward therefrom, said surface member having an axial bore formed therein, said axial bore extending through an entire longitudinal length of said support member;

a mobile rectilinear rod having a fixed longitudinal length telescopically seated within said bore, said rod being centrally disposed above said base member and having a top end terminating at a location above and exterior of said support member;

a circular dial removably and rotatably positioned about said top end of said rod, said circular dial being seated directly on a top surface of said support member;

an arm telescopically positioned directly about said rod in such a manner that said arm rests on said dial and remains spaced from said support member, said arm being selectively rotatable in clockwise and counter clockwise directions, said arm having a flange portion radially extending from said rod and situated at a position beyond an outer perimeter of said base member such that the athlete can readily access said arm while remaining spaced from said base member;

a plurality of padded punching pillows directly affixed to front and rear sides of said flange portion; and a plurality of protective covers directly affixed to said punching pillows respectively, each of said protective covers being detachable from corresponding ones of said punching pillows.

2. The device of claim 1, wherein said arm and said rod are telescopically detachable from said support member so that the athlete can quickly disassemble said device.

3. The device of claim 1, wherein said dial has a diameter smaller than a diameter of said support member such that said dial remains supported at equilibrium and along a horizontal plane while said arm rotates thereon.

4. The device of claim 3, wherein said dial remains stationary when said arm rotates about a fulcrum axis defined along said rod.

5. The device of claim 1, wherein said flange portion of said arm has an oval shape for simulating a trainer hand during exercising procedures.

6. The device of claim 1, wherein said arm comprises:

a stabilizing portion and a vertical portion monolithically formed therewith, said vertical portion having a bore formed therein and arranged in such a manner that said vertical portion is telescopically and rotatably seated about said rod, said stabilizing portion being oppositely positioned from said flange so that said arm is prohibited from undesirably disconnecting from said rod when an upward force is exerted onto said punching pillow.

7. A rotatable training device for improving athlete hand-eye coordination during exercise regimens, said rotatable training device comprising:

a stationary base member having a central aperture formed therein and positioned directly on a ground surface;

an elongated and stationary support member having a bottom end directly nested within said aperture and extending vertically upward therefrom, said surface member having an axial bore formed therein, said axial bore extending through an entire longitudinal length of said support member;

a mobile rectilinear rod having a fixed longitudinal length telescopically seated within said bore, said rod being centrally disposed above said base member and having a top end terminating at a location above and exterior of said support member, wherein said rod includes a spring-loaded stop member directly connected to a bottom end thereof for providing resilient support to said arm during exercise procedures;

a circular dial removably and rotatably positioned about said top end of said rod, said circular dial being seated directly on a top surface of said support member;

an arm telescopically positioned directly about said rod in such a manner that said arm rests on said dial and remains spaced from said support member, said arm being selectively rotatable in clockwise and counter clockwise directions, said arm having a flange portion radially extending from said rod and situated at a position beyond an outer perimeter of said base member such that the athlete can readily access said arm while remaining spaced from said base member;

a plurality of padded punching pillows directly affixed to front and rear sides of said flange portion; and a plurality of protective covers directly affixed to said punching pillows respectively, each of said protective covers being detachable from corresponding ones of said punching pillows.

8. The device of claim 7, wherein said arm and said rod are telescopically detachable from said support member so that the athlete can quickly disassemble said device.

9. The device of claim 7, wherein said dial has a diameter smaller than a diameter of said support member such that said dial remains supported at equilibrium and along a horizontal plane while said arm rotates thereon.

10. The device of claim 9, wherein said dial remains stationary when said arm rotates about a fulcrum axis defined along said rod.

11. The device of claim 7, wherein said flange portion of said arm has an oval shape for simulating a trainer hand during exercising procedures.

12. The device of claim 7, wherein said arm comprises:

a stabilizing portion and a vertical portion monolithically formed therewith, said vertical portion having a bore formed therein and arranged in such a manner that said vertical portion is telescopically and rotatably seated about said rod, said stabilizing portion being oppositely positioned from said flange so that said arm is prohibited from undesirably disconnecting from said rod when an upward force is exerted onto said punching pillow.

13. A rotatable training device for improving athlete hand-eye coordination during exercise regimens, said rotatable training device comprising:

a stationary base member having a central aperture formed therein and positioned directly on a ground surface;

an elongated and stationary support member having a bottom end directly nested within said aperture and extending vertically upward therefrom, said surface member having an axial bore formed therein, said axial bore extending through an entire longitudinal length of said support member;

a mobile rectilinear rod having a fixed longitudinal length telescopically seated within said bore, said rod being centrally disposed above said base member and having a top end terminating at a location above and exterior of said support member, wherein said rod includes a spring-loaded stop member directly connected to a bottom end thereof for providing resilient support to said arm during exercise procedures;

a circular dial removably and rotatably positioned about said top end of said rod, said circular dial being seated directly on a top surface of said support member;

an arm telescopically positioned directly about said rod in such a manner that said arm rests on said dial and remains spaced from said support member, said arm being selectively rotatable in clockwise and counter clockwise directions, wherein said arm is rotatable along a 360 degree arcuate path, said arm having a flange portion radially extending from said rod and situated at a position beyond an outer perimeter of said base member such that the athlete can readily access said arm while remaining spaced from said base member;

a plurality of padded punching pillows directly affixed to front and rear sides of said flange portion; and a plurality of protective covers directly affixed to said punching pillows respectively, each of said protective covers being detachable from corresponding ones of said punching pillows.

14. The device of claim 13, wherein said arm and said rod are telescopically detachable from said support member so that the athlete can quickly disassemble said device.

15. The device of claim 13, wherein said dial has a diameter smaller than a diameter of said support member such that said dial remains supported at equilibrium and along a horizontal plane while said arm rotates thereon.

16. The device of claim 15, wherein said dial remains stationary when said arm rotates about a fulcrum axis defined along said rod.

17. The device of claim 13, wherein said flange portion of said arm has an oval shape for simulating a trainer hand during exercising procedures.

18. The device of claim 13, wherein said arm comprises:

a stabilizing portion and a vertical portion monolithically formed therewith, said vertical portion having a bore formed therein and arranged in such a manner that said vertical portion is telescopically and rotatably seated about said rod, said stabilizing portion being oppositely positioned from said flange so that said arm is prohibited from undesirably disconnecting from said rod when an upward force is exerted onto said punching pillow.

* * * * *